US008893669B2

(12) United States Patent
Mehring et al.

(10) Patent No.: US 8,893,669 B2
(45) Date of Patent: Nov. 25, 2014

(54) HYBRID COOLING SYSTEM OF AN INTERNAL COMBUSTION ENGINE

(75) Inventors: Jan Mehring, Cologne (DE); Bernd Steiner, Bergisch Gladbach (DE); Carsten Weber, Leverkusen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 434 days.

(21) Appl. No.: 13/278,941

(22) Filed: Oct. 21, 2011

(65) Prior Publication Data

US 2012/0118248 A1 May 17, 2012

(30) Foreign Application Priority Data

Nov. 17, 2010 (DE) ..... 10 2010 044 026

(51) Int. Cl.

| | |
|---|---|
| ***F01P 7/00*** | (2006.01) |
| *F01P 3/02* | (2006.01) |
| *F01M 1/12* | (2006.01) |
| *F01P 3/00* | (2006.01) |

(52) U.S. Cl.

CPC ..... *F01P 3/02* (2013.01); *F01P 2003/021* (2013.01); *F01M 2001/123* (2013.01); *F01P 2037/02* (2013.01); *F01P 2003/024* (2013.01); *F01P 2003/008* (2013.01)

USPC ..... 123/41.29; 123/196 R; 123/41.08

(58) Field of Classification Search

CPC ..... F01P 3/00; F01P 7/00; F01P 7/14; F01P 7/165; F01P 2003/027; F02F 1/10

USPC ..... 123/41.02, 41.08, 41.29, 41.44, 41.55, 123/41.72, 41.82 R, 196 R

See application file for complete search history.

(56) References Cited

U.S. PATENT DOCUMENTS

| | | | | |
|---|---|---|---|---|
| 2,188,172 | A * | 1/1940 | Brehob | 123/196 AB |
| 2,446,995 | A * | 8/1948 | Bay | 123/41.08 |
| 4,249,491 | A * | 2/1981 | Stein | 123/142.5 R |

(Continued)

FOREIGN PATENT DOCUMENTS

| | | | |
|---|---|---|---|
| DE | 60005872 | T2 | 9/2004 |
| DE | 102006019086 | A1 | 10/2007 |
| EP | 0239997 | B1 | 8/1991 |

*Primary Examiner* — Noah Kamen
*Assistant Examiner* — Grant Moubry
(74) *Attorney, Agent, or Firm* — Julia Voutyras; Alleman Hall McCoy Russell & Tuttle LLP

(57) ABSTRACT

A hybrid cooling system for an engine is provided. The system comprises a block oil cooling circuit, a head coolant cooling circuit, the head and block circuits having a common heat exchanger. The system also includes a flow device in the head cooling circuit for preventing coolant flow in the head cooling circuit at least during a first phase of a warm-up phase of the internal combustion engine, a delivery device in the block cooling circuit which delivers engine oil constantly under pressure through the block cooling circuit to bearing points in a cylinder block and to bearing points in a cylinder head, and a control element arranged in a control line to reduce the delivery capacity of the delivery device through the block cooling circuit at least during the first phase of the warm-up phase. In this way, heat transfer in the common heat exchanger may be substantially prevented.

6 Claims, 2 Drawing Sheets

(56) References Cited

U.S. PATENT DOCUMENTS

| | | | | | |
|---|---|---|---|---|---|
| 4,332,221 | A * | 6/1982 | Imhof et al. | ..... | 123/41.08 |
| 4,348,991 | A * | 9/1982 | Stang et al. | ..... | 123/41.29 |
| 4,364,339 | A * | 12/1982 | Fricker et al. | ..... | 123/41.42 |
| 4,813,408 | A * | 3/1989 | Katsumoto et al. | ..... | 123/196 AB |
| 5,220,891 | A | 6/1993 | Nakamura et al. | | |
| 5,669,338 | A * | 9/1997 | Pribble et al. | ..... | 123/41.29 |
| 6,340,006 | B1 * | 1/2002 | Malatto et al. | ..... | 123/41.29 |
| 2011/0197832 | A1 * | 8/2011 | Berkemeier et al. | ..... | 123/41.44 |

* cited by examiner

HYBRID COOLING SYSTEM OF AN INTERNAL COMBUSTION ENGINE

RELATED APPLICATIONS

The present application claims priority to German Patent Application No. 102010044026.4, filed on Nov. 17, 2010, the entire contents of which are hereby incorporated by reference for all purposes.

FIELD

The disclosure relates to a hybrid cooling system of an internal combustion engine.

DETAILED DESCRIPTION

Motor vehicles frequently include hybrid cooling systems, wherein both a water-cooled circuit and an oil-cooled circuit are utilized to thermally manage the engine. DE 31 39 621 A1, for example, discloses a cooling system in which the cylinder block is cooled by an engine oil (block cooling circuit), the engine oil simultaneously performing the function of the lubricating oil. The oil, as primary cooling medium, circulates in a primary cooling circuit. The internal combustion engine has a turbocharger which compresses fresh air to be supplied to the internal combustion engine. Said charge air is cooled in a charge-air cooler by heat transfer from cooling water to the charge air. The water, as secondary cooling medium, circulates in a secondary cooling circuit in which the cylinder head is also incorporated. The primary cooling circuit shares a common oil-water heat exchanger with the secondary cooling circuit. Here, in DE 31 39 621 A1, it is the aim, basically without giving specific consideration to a warm-up phase of the internal combustion engine, for the charge air to be able to assume its lowest temperature at maximum torque of the internal combustion engine and to assume its highest temperature at minimum torque.

EP 0 239 997 B1 likewise discloses an internal combustion engine having a hybrid cooling circuit, in which the engine block is cooled by oil and the cylinder head is cooled by water. However, the cylinder head cooling device comprises a water jacket, which is formed around the cylinder head and around the upper cylinder section of the block, for the circulation of cooling water, whereas the rest of the block is cooled by oil.

Said known hybrid cooling circuit, that is to say a cylinder head which is cooled by a water/glycol mixture and a cylinder block which is cooled by oil, is based on the realization that the heat transfer into the cooling medium in the cylinder head is very high, whereas the heat transfer into the oil, that is to say into the cooling medium of the cylinder block, is relatively low. Therefore, efforts are being made to replace the water circuit of the cylinder block with an oil circuit.

By inclusion of a common heat exchanger or a common oil-water heat exchanger, it is possible to merge the two cooling circuits in order to attain heat transfer between the two cooling circuits. In particular, heat is extracted from the oil circulating in the cylinder block. This may be considered to be disadvantageous in particular during a warm-up phase of the internal combustion engine.

The inventors have recognized the issues with the above approaches and provide a hybrid cooling circuit to at least partly address them. In one embodiment, the hybrid cooling system for an internal combustion engine comprises a block cooling circuit through which engine oil flows, a head cooling circuit through which coolant flows, the head and block circuits having a common heat exchanger, a flow device in the head cooling circuit for preventing coolant flow in the head cooling circuit at least during a first phase of a warm-up phase of the internal combustion engine, a delivery device in the block cooling circuit which delivers engine oil constantly under pressure through the block cooling circuit also to bearing points in a cylinder block and also to bearing points in a cylinder head, and a control element arranged in a control line, which control element reduces the delivery capacity of the delivery device through the block cooling circuit at least during the first phase of the warm-up phase.

In this way, during the first warm-up phase, the oil circuit can be operated with sufficient flow to provide lubrication to bearings of the cylinder head and block, while flow through the coolant circuit is prevented to allow rapid engine warm-up. In doing so, engine efficiency may be increased.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
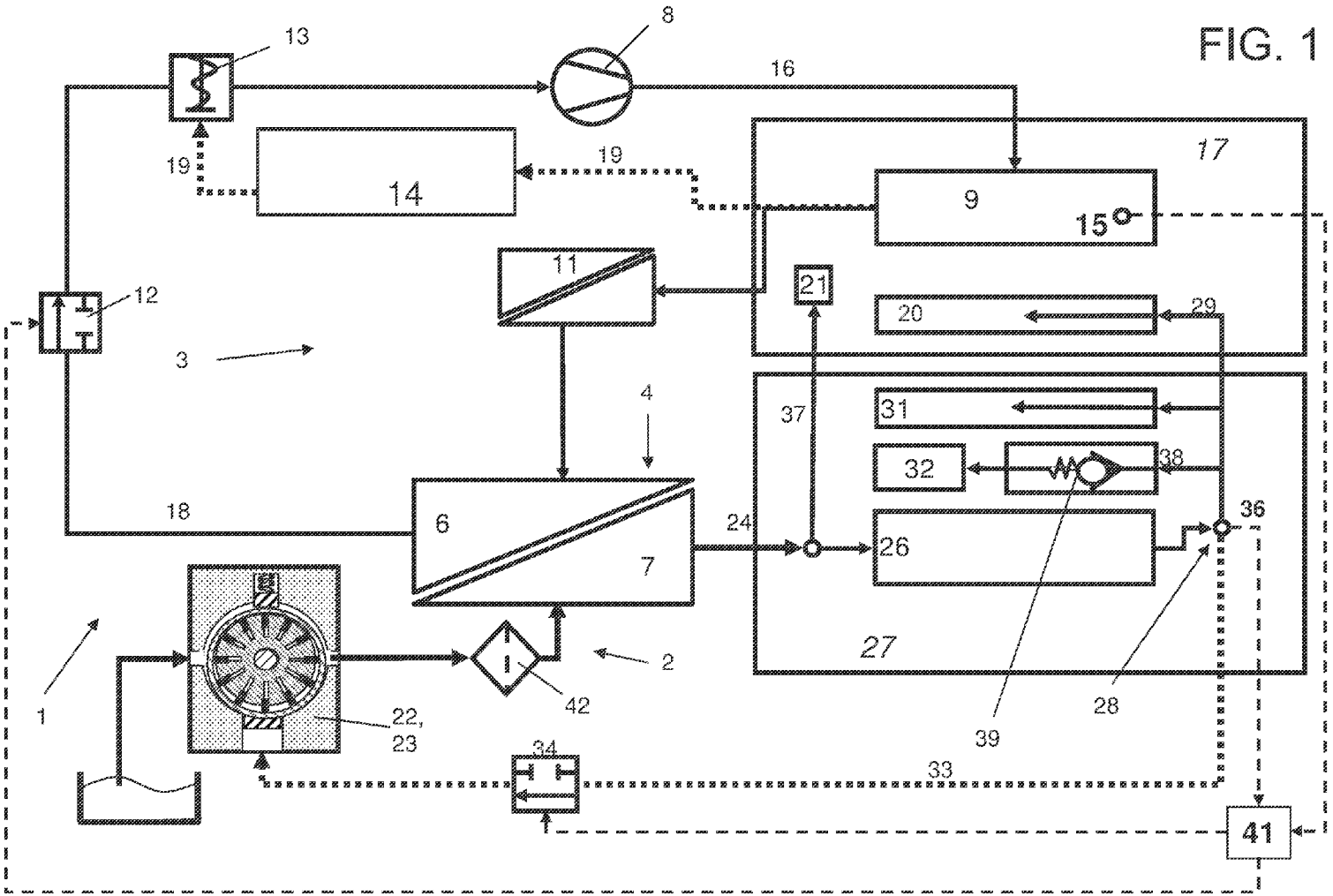
FIG. 1 shows a hybrid coolant circuit of an internal combustion engine according to the disclosure.

FIG. 1 shows a hybrid cooling system 1 of an internal combustion engine, which hybrid cooling system has at least two cooling circuits 2, 3, of which a block cooling circuit 2 is traversed by engine oil and a head cooling circuit 3 is traversed by a liquid cooling medium, the two cooling circuits 2, 3 having a common heat exchanger 4.

The cooling medium of the head cooling circuit 3 is, for example, a water-glycol mixture. The heat exchanger 4 has a so-called water side 6 and a so-called oil side 7. The head cooling circuit 3 is connected to the water side 6 of the heat exchanger 4, with the block cooling circuit 2 being connected to the oil side 7 thereof. No exchange of cooling media takes place in the heat exchanger. The cooling medium of the head cooling circuit 3 will be referred to hereinafter as coolant.

The head cooling circuit 3 also has a pump 8, a head cooling jacket 9, a cabin heat exchanger 11, a shut-off valve 12, a thermostat 13 and a main cooler 14, wherein further components are not illustrated.

In one embodiment, the shut-off valve 12 serves as a way for preventing a coolant flow in the head cooling circuit 3. A coolant flow with a magnitude of zero may also be attained by virtue of the pump 8 being switched off. It is also possible for a bypass line to be provided which bypasses the heat exchanger 4 at the water side in order thereby to prevent a heat transfer.

Proceeding from the pump 8, a connecting line 16 opens out in the cooling jacket 9 of the cylinder head 17. The coolant flows through the head-side coolant jacket 9 and flows into the cabin heat exchanger 11, and from here into the water side 6 of the heat exchanger 4, that is to say of the oil-water heat exchanger 4.

A return line 18 leads from the water side 6 of the heat exchanger 4 back to the pump 8. The shut-off valve 12 is arranged in the return line 18, wherein the thermostat 13 is arranged in the return line 18 downstream of the shut-off valve 12 and upstream of the pump 8. A cooler line 19, in which the main cooler 14 is arranged, branches off upstream of the cabin heat exchanger 11. The cooler line 19 opens out, downstream of the main cooler 14, in the thermostat 13. While the thermostat 13 is arranged in the return line 18, in embodiments described herein, the thermostat does not block coolant flow through the return line 18 from the shut-off valve 12 but rather allows the coolant to flow in this direction. The thermostat 13 may be configured to block coolant flow from the cooler 14, based on the temperature of the coolant in the cooler line 19.

A sensor for measuring the coolant temperature is arranged in the head cooling circuit 3. The sensor is illustrated diagrammatically as a solid circle 15. The sensor is arranged preferably in the head cooling jacket 9 in order to measure an actual coolant temperature. It is possible for yet a further sensor to be provided which measures the inlet-side coolant temperature. In this respect, the further sensor could be arranged directly at the outlet of the pump 8 or at a suitable point of the connecting line 16.

Also shown in the cylinder head 17 are a diagrammatically illustrated bearing point 20 and diagrammatic hydraulic control elements, or hydraulic actuating elements, 21.

A delivery device 22 designed preferably as a variable pump 23 is provided in the block cooling circuit 2 illustrated in FIG. 1. Here, the block cooling circuit 2 opens out, downstream of the delivery device 22, into the oil side 7 of the heat exchanger 4. Downstream of the heat exchanger 4, a connecting line 24 leading from the heat exchanger 4 or from the oil side 7 thereof opens out in the cooling jacket 26 of the cylinder block 27. From the latter, the coolant or the engine oil passes, having undergone a change in temperature (the oil absorbs heat, and thus cools the cylinder block 27), to a junction 28 from which connecting lines 29 lead to bearing points 31 in the cylinder block 27 and also in the cylinder head 17 (bearing point 20). Furthermore, the engine oil may also be supplied, proceeding from the junction 28, to piston cooling devices or piston spray nozzles 32. Also branching off from the junction 28 is the control line 33 in which a control element 34 is arranged. Downstream of the control element 34, the control line 33 opens out at a corresponding inlet of the delivery device 22.

As illustrated by way of example, a temperature sensor 36 is arranged at the junction 28 in order to measure the oil temperature at the outlet side of the cylinder block 27. The temperature sensor 36 is again illustrated as a solid circle.

Upstream of the block cooling jacket 26 there is provided a branch 37 to the hydraulic control elements 21. A check valve 39 is also arranged in the piston cooling line 38 to the piston spray nozzles 32. The illustrated lines may be formed as ducts.

FIG. 1 illustrates in each case only the pressurized lines in the cylinder block 27 and also in the cylinder head 17, wherein corresponding return lines have not been illustrated.

The temperature values of the coolant and of the oil measured by the sensors are transmitted to a control unit 41. This may take place wirelessly or by wire.

Limit values with regard to predefined limit values or threshold temperature values with regard to the oil temperature and the coolant temperature are stored in the control unit 41. The control unit 41 is connected to the control element 34 and to the shut-off valve 12 in order to transmit control signals to these, which may likewise be realized wirelessly or by wire.

A comparison of the actual measured temperatures with predefined temperature limit values, that is to say threshold temperature values, may be carried out in the control unit 41 in order thereby to correspondingly switch the shut-off valve 12 and/or the control element 34 in the control line 33.

It is expedient if, in a first phase of a warm-up phase of the internal combustion engine, the shut-off valve 12 is closed, with the control element 34 being opened. A volume flow in the head cooling circuit 3 can thus be prevented, with a small oil volume flow circulating in the block cooling circuit 2, specifically under pressure through the block cooling jacket 26 to the bearing points 31 and 20 and back again via unpressurized return lines (not illustrated).

The shut-off valve 12 may be fully closed, with the control element 34 being opened, if it is detected in the control unit 41 that the actual coolant temperature (Tcool) is lower than the threshold coolant temperature ($T_1$), if the actual oil temperature (Toil) is lower than the threshold oil temperature ($T_2$), and if the inlet-side coolant temperature (Tinlet) is lower than the opening temperature of the thermostat 13 ($T_3$).

In this way, at least in said first phase of the warm-up phase, a small volume flow through the block cooling circuit 2 is realized and a volume flow through the head cooling circuit 3 is prevented, which results directly in a low power consumption of the delivery device 22 or of the variable oil pump 23, as a result of which a fast warm-up of the liners in the cylinder block 27 is obtained. Since a heat transfer in the heat exchanger 4 can be at least substantially hindered if not completely prevented on account of the prevention of the coolant flow on the water side 6, heated engine oil is thus supplied from the block cooling jacket 26 to the bearing points 31 in the cylinder block 27 and also to the bearing points 20 in the cylinder head 17. This has an advantageous effect on the service life of the bearings; this is because hot engine oil has significantly better lubrication properties than non-heated or cold engine oil. Furthermore, considerable fuel savings may be obtained in the warm-up phase.

The delivery device 22 or the variable oil pump 23 is pressure-regulated, such that it has a low delivery capacity in the case of a high pressure. When the control element 34 is open, the high oil pressure, for example, of the main oil galley is thus transmitted, undiminished, via the control line 33 to the delivery device 22, as a result of which the delivery device delivers with a low delivery capacity, such that a small oil volume flow is generated in the block cooling circuit 2. The control line 33 thus serves substantially only for pressure regulation of the delivery device. It is self-evidently also possible for small quantities of oil to flow through the control line 33.

On account of the control strategy according to the disclosure, that is to say substantially a "no flow strategy" on the water side of the hybrid cooling system, the warm-up behavior of the internal combustion engine is significantly improved at least in the first phase of the warm-up phase of the internal combustion engine, which directly results in reduced emissions. The first phase of the warm-up phase, and the subsequent second phase, that is to say the entire warm-up phase, can thus be reduced in terms of time.

If it is determined in the control unit 41 that the actual coolant temperature (Tcool) is higher than the threshold coolant temperature ($T_1$) (second phase of the warm-up phase), an opening signal, preferably a signal for opening the shut-off valve 12 to a small or partial extent, may be generated in the control unit 41. The control element 34 remains, unchanged, in the open position.

When the shut-off valve 12 is open to a small extent, a small coolant flow is thus generated in the head cooling circuit 3. The volume flow in the block cooling circuit 2 remains small, because the control element 34 in the control line 33 is open. It is thus achieved, like before, that the cylinder liners of the engine warm up quickly and that hot engine oil passes to the bearing points 20 and 31. At the same time, adequate cooling of the cylinder head 17 is attained on account of the small volume flow in the head cooling circuit 3. Here, the volume flow in the head cooling circuit 3 is preferably, in effect, at a minimum, which is achieved by virtue of the shut-off valve 12 being open to a correspondingly small extent.

The warm-up phase is thus completed after a relatively short period of time, wherein the internal combustion engine can be operated in its normal operating state. Here, if it is detected in the control unit 41 that the actual coolant temperature is higher than the threshold coolant temperature and that the actual oil temperature is lower than the threshold oil temperature and that the inlet-side coolant temperature (Tinlet) is higher than the opening temperature of the thermostat 13 ($T_3$), a signal for completely opening the shut-off valve 12 maybe generated in the control unit 41. The control element 34 remains open, wherein the thermostat 13 is open, which may be effected in a temperature-induced manner, that is to say independently of the control unit 41 via a wax element, for example.

With said switching configuration of the control element 34 and also of the shut-off valve 12, adequate cooling both of the cylinder head 17 and also of the cylinder block 27 are attained in normal operation of the internal combustion engine with low power consumption of the delivery device 22 or of the variable oil pump 23.

In contrast, if the internal combustion engine is in a high temperature operating mode defined, for example, by the expression "crazy driver mode", the control unit 41 may identify that the actual coolant temperature is higher than the threshold coolant temperature and that the actual oil temperature is higher than the threshold operating temperature and that the inlet-side coolant temperature is higher than the opening temperature of the thermostat 13, such that a signal for closing the control element 34 in the control line 33 may be generated, wherein the shut-off valve 12 and the thermostat 13 are open, preferably fully open.

As a result of the closure of the control element 34, a low oil pressure is conducted to the delivery device 22 or the variable oil pump 23, as a result of which the delivery capacity of the pressure-regulated delivery device 22 is increased, which directly results in an increase of the oil pressure (however, on account of the closed control element 34, the delivery device still receives a low control pressure like before). The oil pressure of increased magnitude is sufficient to open the check valve 39 in the piston cooling line 38, in order thereby to cool the piston by the piston cooling device, that is to say the piston spray nozzles 32 (criterion: Ppcj greater than Ppcj, open). At the same time, the volume flow both in the head cooling circuit 3 and also in the block cooling circuit is at a maximum, which leads to a maximum heat transfer in the heat exchanger 4. The cylinder head and cylinder head are thus adequately cooled. FIG. 1 also shows an oil filter 42 in the block cooling circuit.

Thus, FIG. 1 provides for a coolant system of a vehicle. In one embodiment, the coolant system comprises a cylinder head coolant circuit including a first loop controlled by shut-off valve arranged downstream of a heat exchanger and upstream of a pump, the pump to pump coolant through a head coolant jacket before reaching the heat exchanger. The system also includes a cylinder block oil circuit including a control element arranged upstream of variable oil pump, the heat exchanger arranged downstream of the variable oil pump, the variable oil pump to pump oil through the heat exchanger to a block coolant jacket, and a control system including instructions to close the shut-off valve to block flow through the coolant circuit and open the control element to provide a first amount of oil through the oil circuit when a temperature of coolant in a cylinder head jacket is below a first threshold.

In one embodiment, the warm-up phase ends when the coolant has reached its operating temperature, that is to say when a main thermostat opens, which may be the case at a coolant temperature at the thermostat of, for example, 90° C., and when the oil at the outlet side of the block is at a limit temperature of, for example, 140° C. In contrast, the first phase of the warm-up phase may end at a coolant temperature which may have a value of, for example, 120° C., wherein this refers to a coolant temperature in the cylinder. Said temperature may be measured. It is however also conceivable for a model to be stored which simulates the injected fuel quantity and which, as a function of the injected fuel quantity, signals that the warm-up phase or the first phase thereof has ended. It is also possible for a component temperature to be taken into consideration for making a decision regarding the end of the warm-up phase or the first phase thereof.

The common heat exchanger has an oil side and a water side which prevent an exchange of medium between the two circuits but nevertheless permit a heat transfer. By preventing flow of the head cooling circuit as described in the disclosure, a heat transfer in the common heat exchanger is advantageously prevented in a first phase of the warm-up phase.

The flow device for preventing the coolant flow may advantageously be designed as a shut-off valve which is arranged in the head cooling circuit. A heat transfer in the heat exchanger is thus expediently prevented by the shut-off valve in the head cooling circuit, that is to say in effect by a "water-side no-flow strategy". It is also possible for other devices to be provided for preventing a coolant flow and/or for preventing a heat transfer in the common heat exchanger. It is, for example, conceivable for an electric water pump or a switchable water pump to be switched into a zero-delivery event, such that a coolant flow is likewise prevented because the water pump does not deliver coolant or does not contribute to the circulation thereof. A bypass which bypasses the water side may also be provided for preventing a heat transfer. Furthermore, a thermostat valve may also be provided, embodied for example as a wax thermostat.

In one embodiment, it may be provided that the delivery device is designed as a variable oil pump. Here, the block cooling circuit, proceeding from the delivery device, opens out downstream of the delivery device into the oil side of the heat exchanger. Downstream of the heat exchanger, a connecting line leading from the heat exchanger opens out in the cooling jacket of the cylinder block. From the latter, the coolant or the engine oil passes, having undergone a change in temperature (e.g., the oil absorbs heat, and thus cools the cylinder block), to a junction from which connecting lines lead to bearing points in the cylinder block and also in the cylinder head. Furthermore, the engine oil may also be supplied, proceeding from the junction, to piston spray nozzles. Also branching off from the junction is the control line in which the control element is arranged. Here, the control line opens out directly in a corresponding inlet of the variable pump.

The junction may actually be designed as a line junction, that is to say as a distributor. Provision may also be made for the junction to be formed from a plurality of T-pieces which are connected to a duct.

Downstream of the heat exchanger, in the block cooling circuit, there may also be provided a branch line to hydraulic control units in the cylinder head, such as for example camshaft adjusters. Since the branch line is arranged downstream of the heat exchanger, that is to say also upstream of the block-side cooling jacket, the oil branched off here has not undergone as extreme a temperature change as downstream of the block-side cooling jacket.

The head cooling circuit may comprise components such as a cabin heat exchanger, the shut-off valve, a thermostat, a main cooler, a pump and the cooling jacket of the cylinder head, though this list should not be regarded as being restrictive. Also conceivable are further components known from cooling systems. Proceeding from the pump (as discussed above, the pump may effect a zero flow; the shut-off valve could then be dispensed with), a connecting line opens out in the cooling jacket of the cylinder head. The cooling jacket of the cylinder head may be divided into an inlet side and an outlet side; this should be regarded as also being encompassed by the disclosure. However, a single coolant jacket both for the inlet side and also for the outlet side is embodied herein. The cooling medium, for example a water-glycol mixture, flows through the head-side cooling jacket and flows into the cabin heat exchanger, and from here into the water side of the heat exchanger, that is to say of the oil-water heat exchanger. A return line leads from the water side of the heat exchanger back to the pump. The shut-off valve is arranged in the return line, wherein the thermostat is arranged in the return line downstream of the shut-off valve and upstream of the pump. A cooler line, in which the main cooler is arranged, branches off upstream of the cabin heat exchanger. The cooler line opens out, downstream of the main cooler, in the thermostat. The thermostat serves preferably to open or close the cooler line based on a temperature of the coolant in the cooler line while allowing flow through the return line.

The flow device for preventing the coolant flow, embodied preferably as a shut-off valve, and the control element are connected to a control unit, for example to a central control unit of the internal combustion engine or of the motor vehicle. A signal transmission may take place wirelessly or by wire. Firstly, a temperature of the coolant at the outlet side of the cylinder head cooling jacket, and secondly, the temperature of the oil at the outlet side of the block cooling jacket, are supplied to the control unit by suitable measurement devices, wherein a temperature measurement preferably takes place at the junction of the block cooling jacket. The corresponding inlet temperatures may also be measured. Limit values with regard to threshold oil temperatures and threshold coolant temperatures, and also an opening temperature of the thermostat (for example a melting temperature of the wax element) are stored in the control unit. The cooling medium of the head cooling circuit is referred to for the sake of simplicity as coolant, wherein the cooling medium of the block circuit is referred to as oil.

A comparison between the corresponding temperatures can be carried out in the control unit, such that different switching states both of the control element in the control line and also of the shut-off valve can be generated.

If it is detected that the actual coolant temperature (Tcool) is lower than the threshold coolant temperature ($T_1$) and the actual oil temperature (Toil) is lower than the threshold oil temperature ($T_2$) and the inlet-side coolant temperature (Tinlet) is lower than the opening temperature of the thermostat ($T_3$), the control element in the control line of the block cooling circuit is opened and the shut-off valve and the thermostat are closed. Such temperature parameters may indicate a first phase of the warm-up phase. In said phase, the shut-off valve is fully closed, so that no coolant flows in the head cooling circuit. If the control element is open, a relatively high pressure in the block cooling circuit is conducted to the delivery device via the control line, which results in a reduced delivery capacity.

The delivery device, that is to say the variable oil pump, accordingly delivers oil with a low capacity on account of the open state of the control element, which results in a small oil volume flow in the block cooling circuit. This results in low power consumption of the delivery device. A circulation of the coolant in the head cooling circuit is prevented by the closed shut-off valve, for which reason also a negligible or substantially insignificant heat transfer takes place in the heat exchanger in the first phase of the warm-up phase. This leads directly to a relatively fast warm-up of the cylinder liners and therefore to a high oil temperature at the bearing inlets, because the oil volume flow in the block cooling jacket is also low. Higher oil temperatures are however highly conducive to a longer service life of the bearings, wherein furthermore the warm-up phase can be shortened. Furthermore, on account of the high temperature, the oil has favorable friction parameters, which result directly in reduced fuel consumption.

If a comparison of the temperatures in the control unit yields that the actual coolant temperature is higher than the threshold coolant temperature, in a second phase of the warm-up phase, the shut-off valve receives an opening signal from the control unit, resulting in a minimal coolant flow in the head cooling circuit and also through the water side of the heat exchanger. The shut-off valve may be controlled by pulse width modulation (e.g., sawtooth control). In said operating state of the internal combustion engine, the control element of the block circuit remains open, wherein the thermostat is still closed because its opening temperature has nevertheless not yet been reached.

The delivery device, that is to say the variable oil pump, delivers oil with a low capacity on account of the open state of the control element, which results in a small oil volume flow in the block cooling circuit. This results in low power consumption of the delivery device. As a result of the open state of the shut-off valve, a low level of circulation of the coolant in the head cooling circuit is made possible, which on account of the detected threshold temperature of the coolant contributes to adequate cooling of the cylinder head. Nevertheless, a substantially negligible heat transfer still takes place in the heat exchanger because the coolant in the head cooling circuit flows with a low volume flow, which in turn leads directly to a relatively fast warm-up of the cylinder liners and therefore to a high oil temperature at the bearing inlets, because the oil volume flow in the block cooling jacket is low in said second phase of the warm-up phase too, and therefore in effect a very small heat transfer is to be expected.

If a normal operating state is identified in which it is detected that the actual coolant temperature is higher than the threshold coolant temperature but the actual oil temperature is lower than the threshold oil temperature and the inlet-side coolant temperature is higher than the opening temperature of the thermostat, the control element and the shut-off valve are opened by the corresponding signal from the control unit, wherein the thermostat (for example wax element) opens automatically in a temperature-induced manner. In said control state, flow passes through the heat exchanger both at the water side and at the oil side, such that a heat transfer can take place. Adequate cooling both of the block and also of the head can thus be attained, with the delivery device having minimal energy consumption.

Also encompassed by the control strategy is a high temperature operating state of the internal combustion engine, such as may arise for example in a so-called "crazy driver" operating mode, that is to say for example in the event of intense loading of the engine directly after a cold start. If it is detected that the actual coolant temperature is higher than the threshold coolant temperature and that the actual oil temperature is higher than the threshold oil temperature and that the inlet-side coolant temperature is higher than the opening temperature of the thermostat, the control unit generates a signal for closing the control element in the control line and for opening the shut-off valve in the head cooling circuit, wherein the thermostat is open on account of the temperature (wax element). In this way, a high oil pressure is generated because the delivery device delivers oil at high capacity into the block cooling circuit and bearing points connected thereto and also to the piston cooling devices (oil spray nozzles), such that the oil pressure prevailing at the piston cooling devices (oil spray nozzles) is higher than the opening pressure thereof or than a pressure at which a check valve arranged in the corresponding lines opens. As a result, in each case maximum volume flows in the two circuits, that is to say also in the common heat exchanger on the water and oil sides thereof, an adequate heat transfer can take place, that is to say it is possible even in a high temperature operating state for the cylinder head to be adequately cooled and for the cylinder block to be kept at the required high temperature. As a result of the closed control element in the control line, a low oil pressure is conducted to the delivery device, as a result of which the capacity of the delivery device is high.

Within the context of the disclosure, therefore, the control line serves substantially to transmit the oil pressure. The delivery device thus has, in effect, a pressure-regulated capacity. It is also possible for small amounts of oil to flow through the control line.

Figure 2:
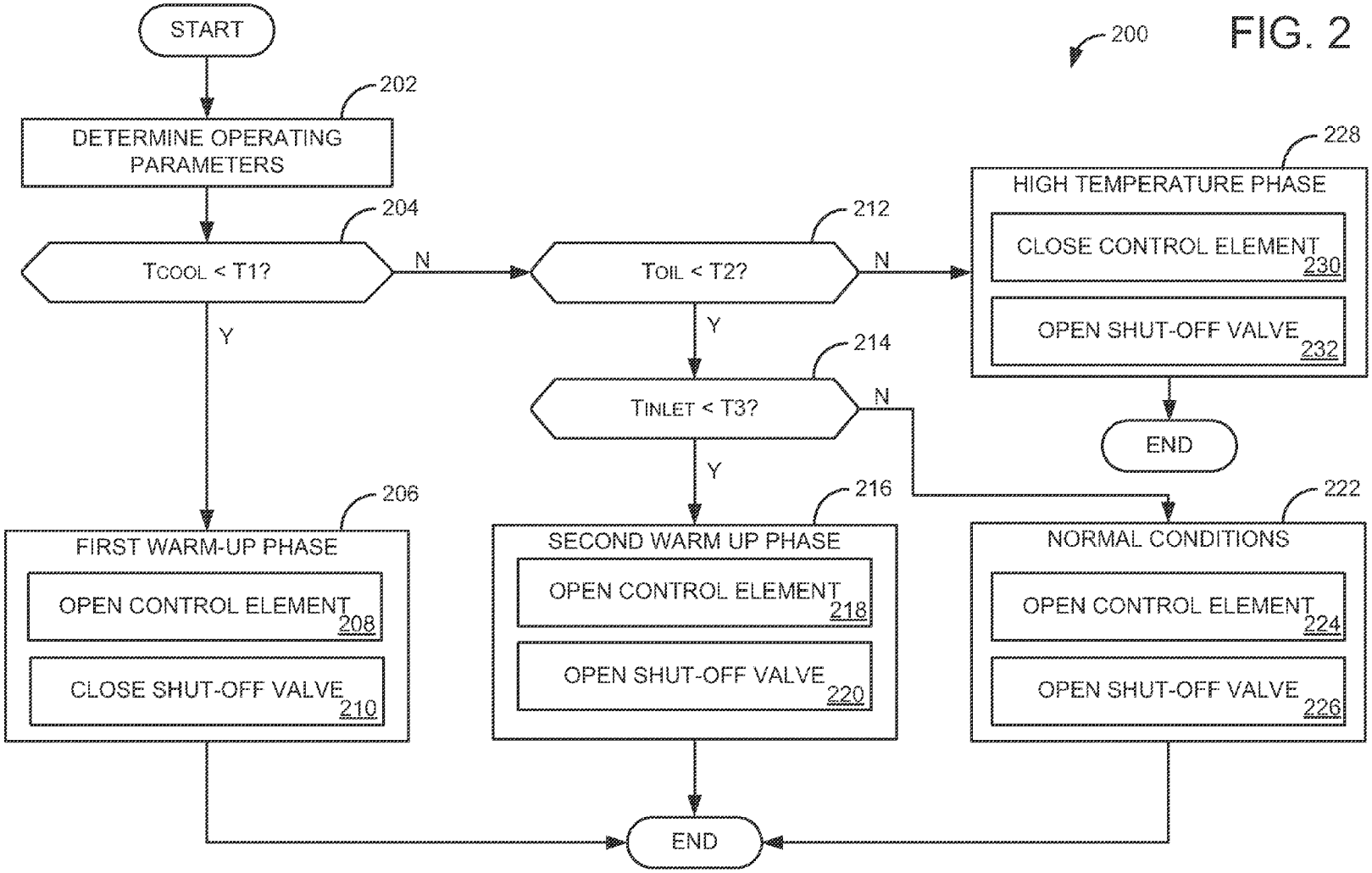
FIG. 2 is a flow chart illustrating an example method for cooling an engine according to an embodiment of the present disclosure.

FIG. 2 shows a flow chart illustrating a method 200 for cooling an engine using the control strategy explained above. Method 200 may be carried out by a control unit of a vehicle, such as control unit 41. Method 200 comprises, at 202, determining engine operating parameters. Engine operating parameters may include the temperature of the coolant in the cylinder head coolant jacket, the temperature of the oil at the outlet of the cylinder block coolant jacket, the temperature of the coolant at the inlet of the coolant jacket, engine speed, engine load, etc. The engine operating parameters may be determined from signals received from various sensors, such as sensor 15 and sensor 36.

At 204, method 200 comprises determining if the coolant temperature (Tcool) in the cylinder head coolant jacket, as sensed by sensor 15, is below a first threshold (T1). The first threshold may be any suitable threshold, as discussed above, such as normal engine operating temperature. If the coolant temperature is below the threshold, it indicates the cylinders in the engine are not at operating temperature. Thus, method 200 proceeds to 206 to operate in a first warm-up phase in order to rapidly warm the engine. The first warm-up phase includes opening the control element, such as element 34, of the block oil circuit at 208. Opening the control element allows the oil to reach the variable oil pump 23 at full pressure, which in turn pumps the oil at a reduced capacity. Thus, a first amount of oil is pumped through the block oil circuit to provide lubrication to the bearings of the cylinder head and block, as well as warm the engine oil. To initiate rapid engine warm-up, the first warm-up phase includes closing the shut-off valve, such as valve 12, at 210. By closing the shut-off valve, coolant is prevented from flowing through any part of the cylinder coolant circuit, and thus no cooling is provided to the cylinder head.

If it is determined at 204 that the coolant temperature in the coolant jacket is not below the threshold, method 200 proceeds to 212 to determine if a temperature of the oil (Toil) at the outlet of the block coolant jacket is below a second threshold (T2). The second threshold may any suitable threshold, such as described above. The second threshold may be higher than the first threshold, as it may be advantageous to heat the engine oil to a higher temperature than the coolant in order to decrease oil viscosity and improve engine efficiency. Further, the cooling requirements of the cylinder block may be less than that of the cylinder head, as the cylinder head includes components which may be heat-sensitive, such as the valve components. If the oil temperature is not less than the threshold T2, method 200 proceeds to 228, which will be described in more detail below. If the oil temperature is less than the second threshold, method 200 proceeds to 214 to determine if the temperature of the coolant at the inlet of the head coolant jacket (Tinlet) is less than a third threshold (T3). The third threshold may be equivalent to the opening temperature of the thermostat, as described above. As the coolant passes through the thermostat in the return line before reaching the pump and then the inlet of the coolant jacket, the temperature of the coolant jacket inlet may be reasonably close to the temperature of the thermostat.

If the inlet temperature is less than the third threshold, method 200 proceeds to 216 to operate in the second warm-up phase. In the second warm-up phase, the control element remains open at 218 to continue to pump the first amount of oil through the oil circuit. However, the shut-off valve opens at 220. In this way, coolant can be pumped through a first loop of the coolant circuit, which includes pumping coolant to the coolant jacket in the cylinder head, to the cabin heater and the coolant side of the common heat exchanger, before traversing the shut-off valve and returning to the pump. The flow amount through the first loop, which is controlled by the shut-off valve, may be regulated by fully or partially opening the shut-off valve. However, because the inlet temperature is not above the third threshold, the coolant is not warm enough to necessitate the additional cooling provided the second loop of the coolant circuit, which routes coolant from the coolant jacket through the main cooler (e.g., radiator). The flow through the second, cooling portion of the coolant circuit is thus blocked by the thermostat being blocked closed.

If the inlet temperature is not less than the third threshold at 214, method 200 proceeds to 222 to operate under normal operating conditions. In this case, the engine temperature is at normal operating temperature, and both the head and block circuits are provided with standard cooling amounts. This includes maintaining the control element open at 224 and the shut-off valve open at 226. The thermostat is also open under these conditions. In this way, full flow is provided through both the first and second loops of the head coolant circuit, with a first, minimal flow through the block oil circuit.

Returning back to 212, if it is determined that the oil temperature is above the second threshold, method 200 proceeds to 228 to operate under high temperature conditions. In this case, the oil has reached a temperature that may indicate an engine operating temperature that is high enough to cause damage to the engine and/or associated engine components. To rapidly cool the engine, the control element is closed at 230 and the shut-off valve is open at 232. By closing the control element, minimal or no oil pressure reaches the variable oil pump. As a result, the oil pump operates with higher volume capacity, and may pump oil from an oil pan. This second amount of oil pumped through the oil circuit when the control element is closed may be greater than the first amount of oil pumped through the oil circuit when the control element is open. Thus, both the oil and coolant circuits are operating at full flow to cool the engine. Additionally, the piston cooling jets may be provided with oil, as the increased oil pumped by the oil pump may produce enough pressure at the check valve to admit oil to the piston cooling jets. As a result, even more cooling can be provided to quickly cool the engine.

After determining which of the operating modes to operate in, and adjusting the shut-off valve and/or control element accordingly, method 200 ends. Method 200 provides for routing coolant and oil through different cooling circuits, to provide varying amounts of heating and cooling to the engine. Additionally, by using a variable oil pump controlled by the oil pressure introduced to the pump via the control element, the oil pump may consume less power and operate more efficiently.

Thus, FIG. 2 provides for a method for an engine having a block oil circuit and a head coolant circuit, the head and block circuits having a common heat exchanger. The method comprises preventing coolant flow in the head circuit at least in a first phase of a warm-up phase of the engine, the warm-up phase including a coolant temperature lower than a first threshold and an oil temperature lower than a second threshold, with a control element of the block oil circuit being open.

In summary, the control strategy for the exemplary embodiment illustrated in FIG. 2 can be illustrated by the following Table 1:

TABLE 1

| Operating state | Delivery device 22 | Shut-off valve 12 | Thermostat 13 | Criterion |
|---|---|---|---|---|
| Warm-up phase (phase 1) | open | closed | closed | Tcool < $T_1$<br>Toil < $T_2$<br>Tinlet < $T_3$ |
| Warm-up phase (Phase 2) | open | open or PWM-controlled | closed | Tcool > $T_1$<br>Toil < $T_2$<br>Tinlet < $T_3$ |
| Normal operating state | open | open | open | Tcool > $T_1$<br>Toil < $T_2$<br>Tinlet > $T_3$ |
| High temperature operating state | closed | open | open | Tcool > $T_1$<br>Toil > $T_2$<br>Tinlet > $T_3$<br>pPCJ > pPCJ, open |

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A coolant system of a vehicle, comprising:

a cylinder head coolant circuit including a first loop controlled by a shut-off valve arranged downstream of a heat exchanger and upstream of a pump, the pump to pump coolant through a head coolant jacket before reaching the heat exchanger, a second loop including a thermostat to control coolant flow from a main cooler to the pump;

a cylinder block oil circuit including a control element arranged upstream of a variable oil pump, the heat exchanger arranged downstream of the variable oil pump, the variable oil pump to pump oil through the heat exchanger to a block coolant jacket; and a control system including instructions to:

close the shut-off valve to block flow through the coolant circuit and open the control element to provide a first amount of oil through the oil circuit when a temperature of coolant in a cylinder head jacket is below a first threshold; and close the thermostat to block coolant flow through the second loop when an inlet coolant temperature is below a third threshold.

2. The coolant system of claim 1, wherein the control system further includes instructions to open the shut-off valve while keeping the control element open when the coolant temperature in the cylinder head jacket is above the first threshold and a temperature of oil in the oil circuit is below a second threshold.

3. The coolant system of claim 1, wherein the control system further includes instructions to open the shut-off valve to pump coolant through the first loop while keeping the control element open when the coolant temperature in the cylinder head jacket is above the first threshold and a temperature of oil in the oil circuit is below a second threshold, and wherein if the inlet coolant temperature is above the third temperature, coolant also flows through the second loop.

4. The coolant system of claim 1, wherein the control system further includes instructions to open the shut-off valve to pump coolant through the first loop, and close the control element to pump a second amount of oil through the oil circuit when the coolant temperature in the cylinder head jacket is above the first threshold and when an oil temperature is above a second threshold.

5. The coolant system of claim 4, wherein the first oil amount is less than the second oil amount, and wherein the first oil amount is pumped with less pressure than the second oil amount.

6. The coolant system of claim 4, further comprising a check valve to control oil flow to one or more piston cooling jets, and wherein when the control element is closed, pressure from the pumping of the second oil amount opens the check valve to flow oil to the one or more piston cooling jets.

* * * * *